US005172500A

United States Patent [19]

Renski et al.

[11] Patent Number: 5,172,500

[45] Date of Patent: Dec. 22, 1992

[54] PIN RETAINER ASSEMBLY

[75] Inventors: William J. Renski, Peoria; Preston L. Gale, Morton, both of Ill.

[73] Assignee: Caterpillar Inc., Peoria, Ill.

[21] Appl. No.: 838,012

[22] Filed: Feb. 21, 1992

[51] Int. Cl.[5] ..... E02F 9/28

[52] U.S. Cl. ..... 37/142 A; 411/353; 411/517; 37/142 R

[58] Field of Search ..... 37/142 A, 142 R; 404/102; 411/352, 353, 517, 516

[56] References Cited

U.S. PATENT DOCUMENTS

| | | | |
|---|---|---|---|
| 1,844,463 | 2/1932 | Dodd | 411/352 |
| 3,289,726 | 12/1966 | Sauter | 37/142 A |
| 3,959,901 | 6/1976 | Klett | 37/142 R |
| 3,997,989 | 12/1976 | Stepe | 37/142 R |
| 4,324,517 | 4/1982 | Dey | 411/353 |
| 4,464,090 | 8/1984 | Dwan | 411/353 X |
| 4,594,040 | 6/1986 | Molina | 411/353 |
| 4,823,486 | 4/1989 | Diekevers et al. | 37/142 R |
| 4,918,843 | 4/1990 | Keisewetter et al. | 37/142 A |

FOREIGN PATENT DOCUMENTS

| | | | |
|---|---|---|---|
| 706588 | 12/1979 | U.S.S.R. | 411/352 |

*Primary Examiner*—Randolph A. Reese
*Assistant Examiner*—Arlen L. Olsen
*Attorney, Agent, or Firm*—J. W. Burrows

[57] ABSTRACT

Pin retainers are normally used to secure a pin in its assembled so that one member can be releasably secured to another member, such as, securing a tooth to an adapter nose. Many times the pin retainer is not sufficiently strong to hold the pin in place under adverse operating conditions. Known pin retainers that are effective to hold the pin in place are not readily available and are expensive to produce. In the subject arrangement, a pin retainer assembly is provided which can be made from known components and is effective to hold a pin in place under adverse operating conditions. The pin retainer assembly includes a split retaining ring loosely sandwiched between at least two retaining members and held together by various known bonding or securing methods.

22 Claims, 6 Drawing Sheets

Fig. 3
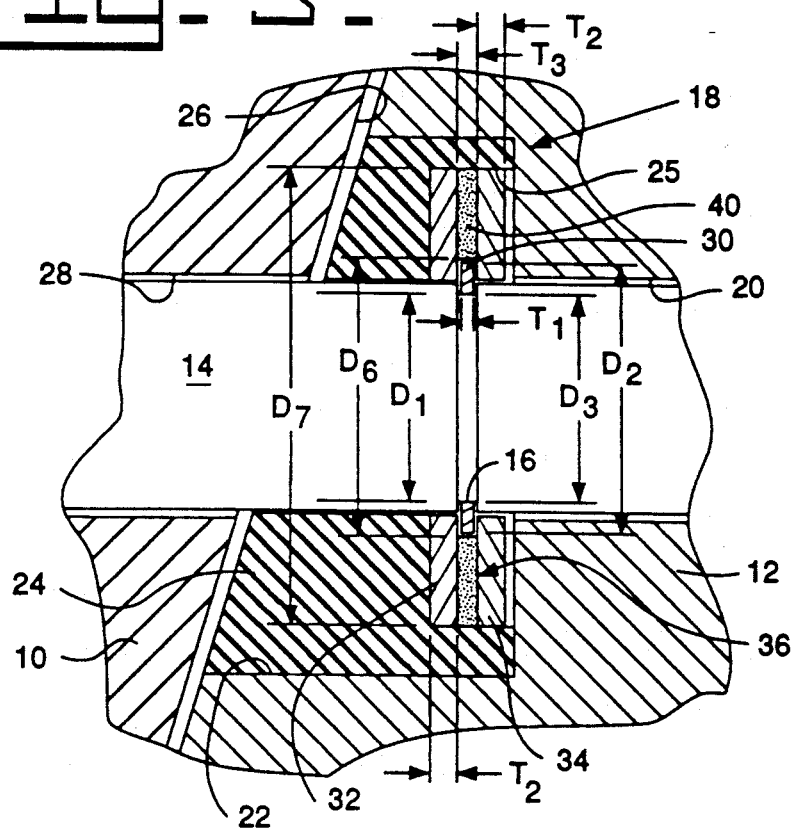
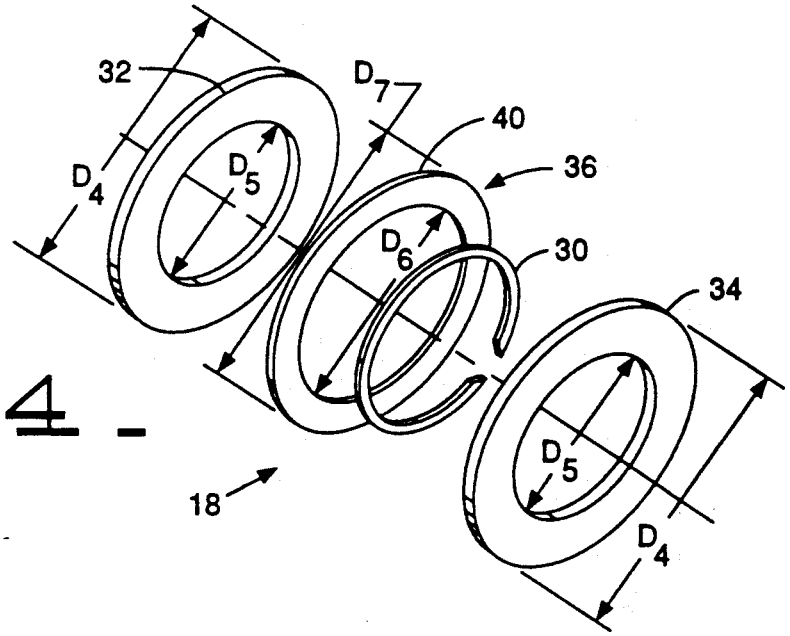
Fig. 4

Fig. 11
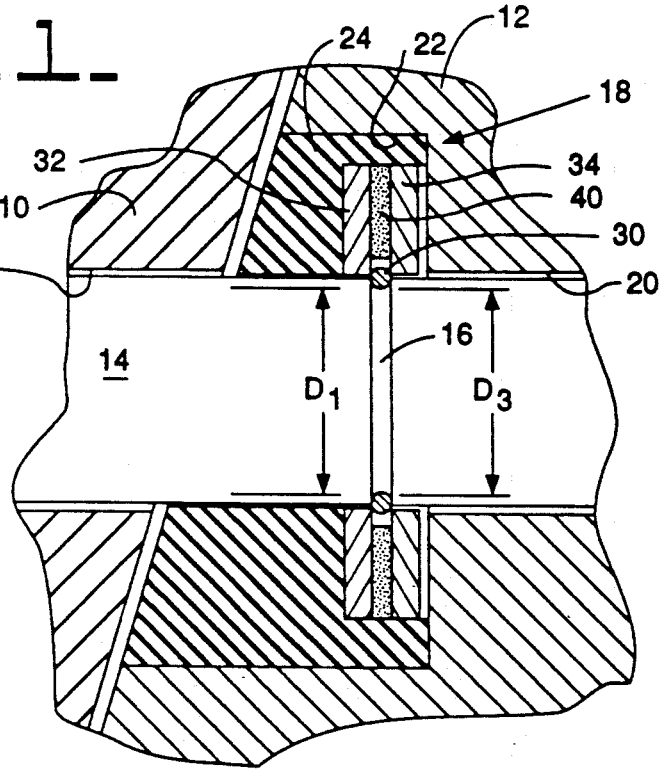
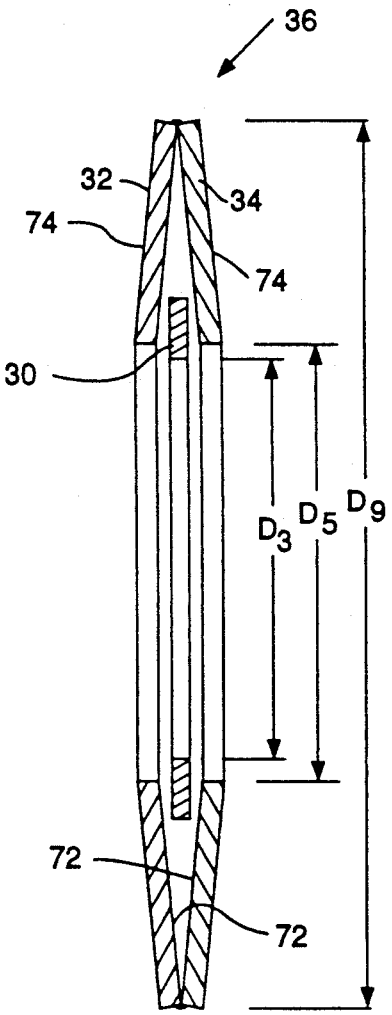
Fig. 12

PIN RETAINER ASSEMBLY

TECHNICAL FIELD

This invention relates generally to a pin retainer and more particularly to a pin retainer assembly which is made from several elements.

BACKGROUND ART

Pin retainers are generally used to hold a pin in an assembled position. One typical example is U.S Pat. No. 3,959,901 which issued Jun. 1, 1976 to Gene R. Klett. This arrangement teaches a ground engaging tooth which is mounted on an adapter nose and secured in the assembled position by a pin. The pin is held in its assembled position by a pin retainer.

In many applications, the pin retainer noted above is not sufficient to hold the pin in position. Another arrangement to hold a pin in the assembled position is taught in U.S. Pat. No. 3,997,989 which issued Dec. 21, 1976 to V. A. Stepe. In this arrangement, the pin retainer includes a spring member embedded in an elastomeric material.

A more positive pin retaining arrangement is illustrated in U.S. Pat. No. 4,823,486 which issued Apr. 25, 1989 to Mark S. Diekevers et al. This arrangement teaches the use of a pin having a groove and a pin retaining assembly which includes a washer having a groove defined in the surface of the innermost diameter with a split spring ring loosely captured in the groove. When assembled, the split spring ring fits into the groove of the pin and remains therein. In order to remove the pin, either the split spring ring must be sheared or the side of the washer must be fractured. Even though this arrangement is very effective to hold the pin in position, the pin retainer requires the making and machining of the washer which adds significantly to the cost of the pin retainer.

The present invention is directed to overcoming one or more of the problems as set forth above.

DISCLOSURE OF THE INVENTION

In one aspect of the present invention, a pin retainer assembly is provided and adapted when in use to fit in a space between a tooth and an adapter nose and operative to retain a pin in a position which secures the tooth to the adapter nose. The pin defines a groove therein having a predetermined diameter. The pin retainer assembly includes a split retaining ring having a predetermined width, a predetermined outermost diameter and a predetermined innermost diameter which is generally the same size as the predetermined diameter of the groove defined in the pin. When assembled, the split retaining ring fits into the groove of the pin. The pin retainer assembly also includes at least two retaining members. Each of the at least two retaining members has an innermost diameter that is less than the outermost diameter of the split retaining ring and an outermost diameter that is greater than the outermost diameter of the split retaining ring. The pin retainer assembly is operative to loosely encapsulate the split retaining ring between the at least two retaining members. A means is provided for connecting the at least two retaining members together.

BRIEF DESCRIPTION OF THE DRAWINGS

FIG. 3 is an enlarged cross-section illustrating the invention;

FIG. 4 is an isometric view illustrating the individual components of the invention;

FIG. 11 is an enlarged cross-sectional view similar to FIG. 3 illustrating a modified embodiment of an element therefrom; and FIG. 12 is a cross-sectional view of still another embodiment of the present invention.

BEST MODE FOR CARRYING OUT THE INVENTION

Figure 1:
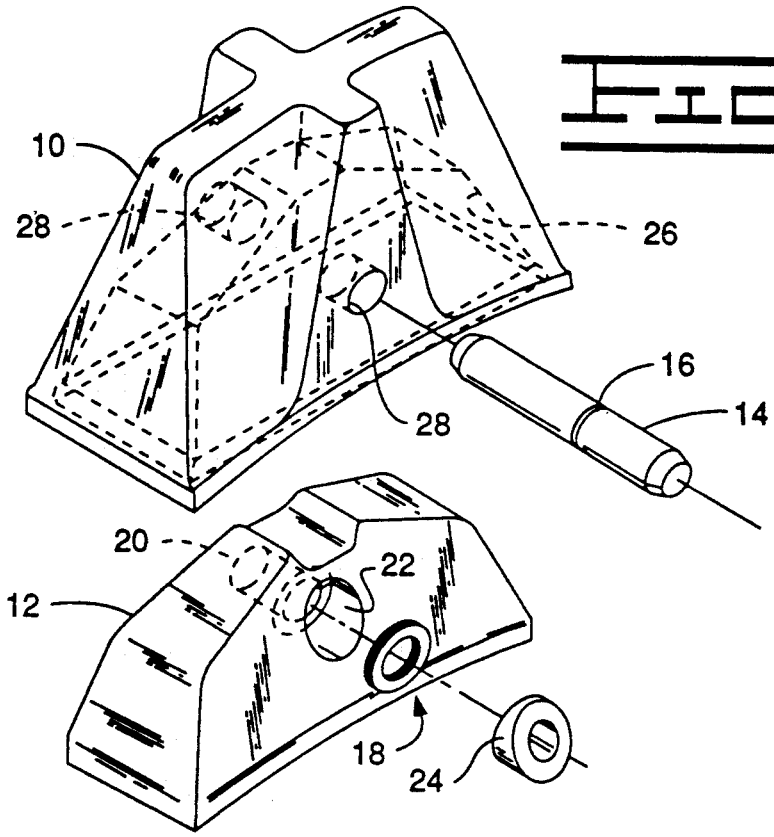
FIG. 1 is an isometric view illustrating an embodiment of the present invention.
Figure 2:
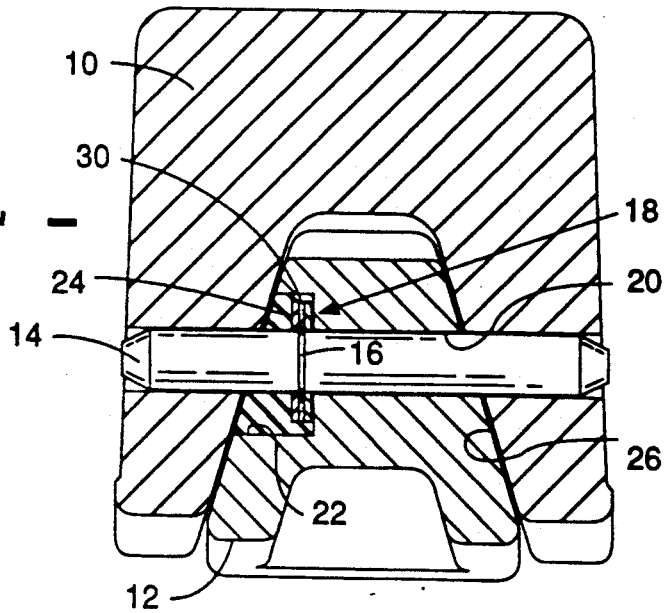
FIG. 2 is an enlarged cross-sectional view of the assembled elements of FIG. 1 which better illustrates a portion of the present invention.

Referring now to the drawings, and more particularly to FIGS. 1–4, a ground engaging tooth 10 and an adapter nose 12 is illustrated. A pin 14 is provided to secure the tooth 10 to the adapter 12. The pin 14 has a groove 16 of a predetermined diameter $D_1$ defined therein. A pin retainer assembly 18 is provided to retain the pin 14 in its assembled position. In the subject arrangement, the adapter nose 12 is adapted to be secured to a compacter wheel (not shown). The adapter nose 12 has a transverse bore 20 defined therein and a counterbore 22 concentric with the transverse bore 20 and located on one side of the adapter nose 12. A centering member 24 having a counterbored hole 25 is provided and adapted to receive, hold, and locate the pin retainer assembly 18 in the counterbore 22. The tooth 10 has a cavity 26 defined therein to receive the adapter nose 12 and a pair of aligned holes 28 are defined therein and separated by the cavity 26.

When assembled, the pin retainer assembly 18 is placed in the counterbored hole 25 of the centering member 24 followed by placing the centering member 24 in the counterbore 22 of the adapter nose 12. Once the cavity 26 of the tooth 10 is placed over the adapter nose 12, the pin 14 is inserted through the pair of aligned holes 28, the centering member 24, the pin retainer assembly 18, and the transverse bore 20 until the groove 16 of the pin 14 is located within the pin retainer assembly 18.

Referring more specifically to FIGS. 3 and 4, the pin retainer assembly 18 will be described in more detail. The pin retainer assembly 18 includes a split retaining ring 30, at least two retaining members 32,34, and a means 36 for connecting the at least two members together. The split retaining ring 30 has a predetermined thickness $T_1$, a predetermined outermost diameter $D_2$, and a predetermined innermost diameter $D_3$. The cross-section of the split retaining ring 30, taken parallel to the axis thereof, is rectangular in shape.

Each of the at least two retaining members 32,34 has a predetermined thickness $T_2$, a predetermined outermost diameter $D_4$, and a predetermined innermost diameter $D_5$. The predetermined outermost diameter $D_4$ of each of the retaining members 32,34 is larger than the outermost diameter $D_2$ of the split retaining ring 30. The predetermined innermost diameter $D_5$ of each of the retaining members 32,34 is smaller than the outermost diameter $D_2$ of the split retaining ring 30 but larger than the innermost diameter $D_3$ thereof.

The connecting means 36 includes a positioning member 40. The positioning member 40 has a predetermined thickness $T_3$, a predetermined innermost diameter $D_6$, and a predetermined outermost diameter $D_7$. The predetermined thickness $T_3$ of the positioning member 40 is generally equal to or greater than the predetermined thickness $T_1$ of the split retaining ring 30. The predetermined innermost diameter $D_6$ of the positioning member 40 is generally equal to or slightly larger than the outermost diameter $D_2$ of the split retaining ring 30. The outermost diameter $D_7$ of the positioning member 40 of the subject embodiment is generally the same as the outermost diameter $D_4$ of each of the retaining members 32,34.

The positioning member 40 of the subject embodiment is made from a resilient material, such as rubber, cardboard, woven fibers, or any other resilient material. In the subject embodiment, the at least two retaining members 32,34 are standard, readily available metal washers. However, it is recognized that other types and/or sources of materials could be used without departing from the essence of the invention. The at least two retaining members 32,34 and the positioning member 40 are bonded together by any known technique and has the split retaining ring 30 loosely sandwiched therebetween.

Figure 5:
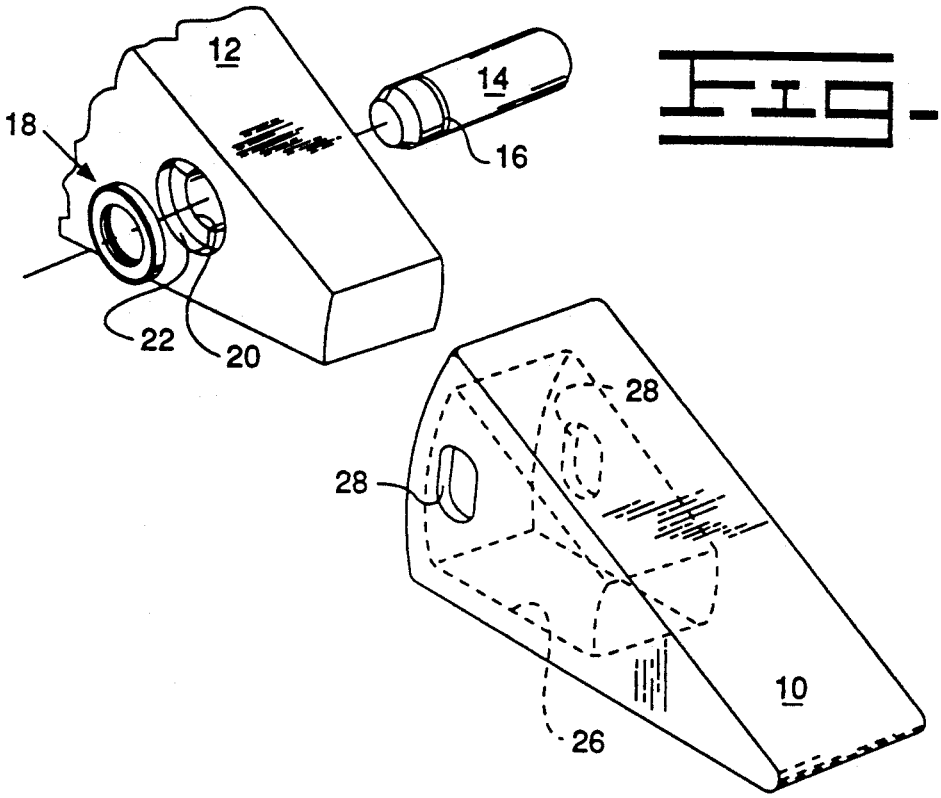
FIG. 5 is an isometric view illustrating another embodiment of the present invention.
Figure 6:
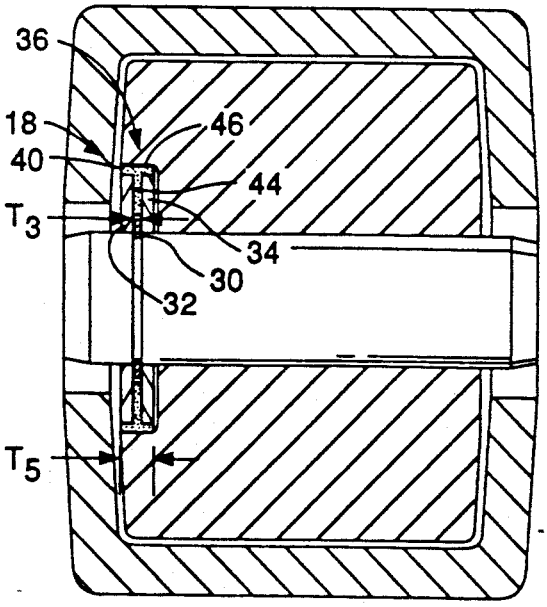
FIG. 6 is an enlarged cross-sectional view of the assembled elements of FIG. 5 which better illustrate a portion of the invention.
Figure 7:
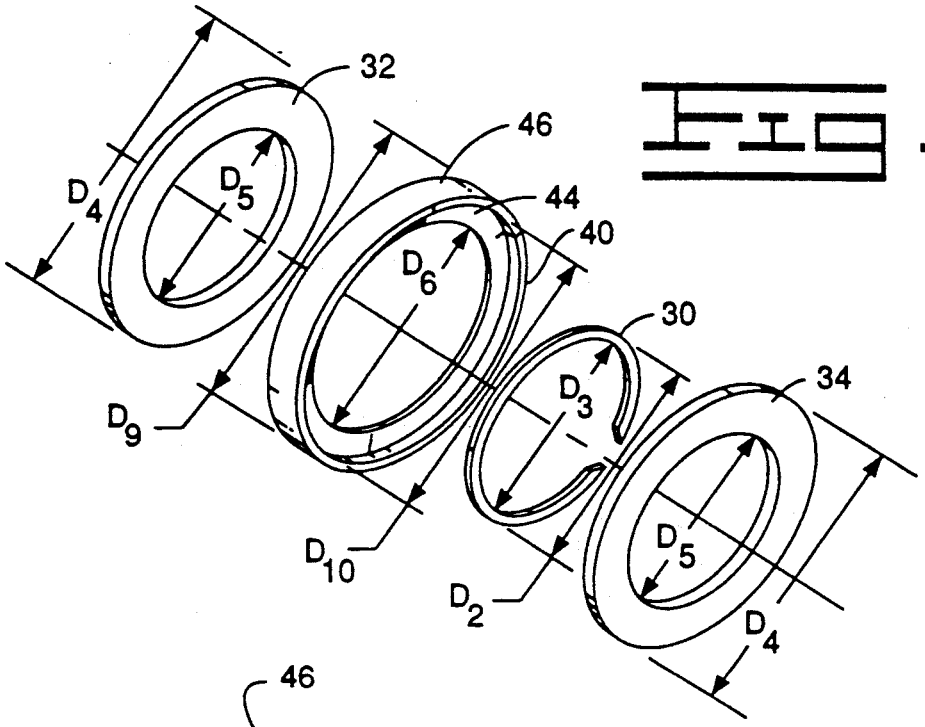
FIG. 7 is an isometric view illustrating the individual components of the invention of FIG. 5.

Referring now to FIGS. 5–7, another embodiment of the present invention is illustrated. In this arrangement, the adapter nose 12 is adapted to be connected to an implement bucket (not shown) and the tooth 10 is a typical implement tooth. The adapter nose 12 of the subject embodiment has the transverse bore 20 and the counterbore 22 concentrically aligned therewith on the one side of the adapter nose 12. The pin retainer assembly 18 likewise fits into the counterbore 22 during assembly. The cavity 26 of the tooth 10 mates with the adapter nose 12 and has the pair of aligned holes 28 defined therein and separated by the cavity 26. The pin 14 having the groove 16 is inserted through the pair of aligned holes 28, the pin retainer assembly 18, and the transverse bore 20 to secure the tooth 10 to the adapter nose 12.

Referring more specifically to FIGS. 6 and 7, the pin retainer assembly 18 of the subject embodiment is better illustrated. In this embodiment, elements the same or similar to elements from previous embodiments have the same element numbers. The split retaining ring 30 and the at least two retaining members 32,34 are the same as those set forth above with respect to FIGS. 1–4. The connecting means 36 of the subject embodiment includes the positioning member 40. In this embodiment the positioning member 40 includes a first portion 44 and a second portion 46. The first portion 44 has the innermost diameter $D_6$ and the thickness $T_3$. The second portion 46 has an outermost diameter $D_9$, an innermost diameter $D_{10}$, and a thickness $T_5$. The first portion 44 is integral with the second portion 46 generally midway along the innermost diameter $D_{10}$ thereof.

The innermost diameter $D_6$ of the first portion 44 of the positioning member 40 is larger than the outermost diameter $D_2$ of the split retaining ring 30. The thickness $T_3$ of the first portion 44 of the positioning member 40 is generally equal to or greater than the thickness $T_1$ of the split retaining ring 30. The innermost diameter $D_{10}$ of the second portion 46 of the positioning member 40 is generally the same as the outermost diameter $D_4$ of each of the at least two retaining members 32,34. The combined thickness of the retaining members 32,34 and the first portion 44 of the positioning member 40 is generally the same as the thickness $T_5$ of the second portion 44 of the positioning member 40.

In the subject arrangement, the at least two retaining members 32,34 are readily available metal washers and the positioning member 40 is made from a plastic material or some other rigid material, such as metal. The at least two retaining members 32,34 are secured to the positioning member 40 by any known bonding technique or by an interference fit between the outermost diameters $D_4$ of the at least two retaining members 32,34 and the innermost diameter $D_{10}$ of the second portion 46 of the positioning member 40. Once the at least two retaining members 32,34 are secured to the positioning member 40, the split retaining ring 30 is loosely sandwiched between the at least two retaining members 32,34.

Figure 8:
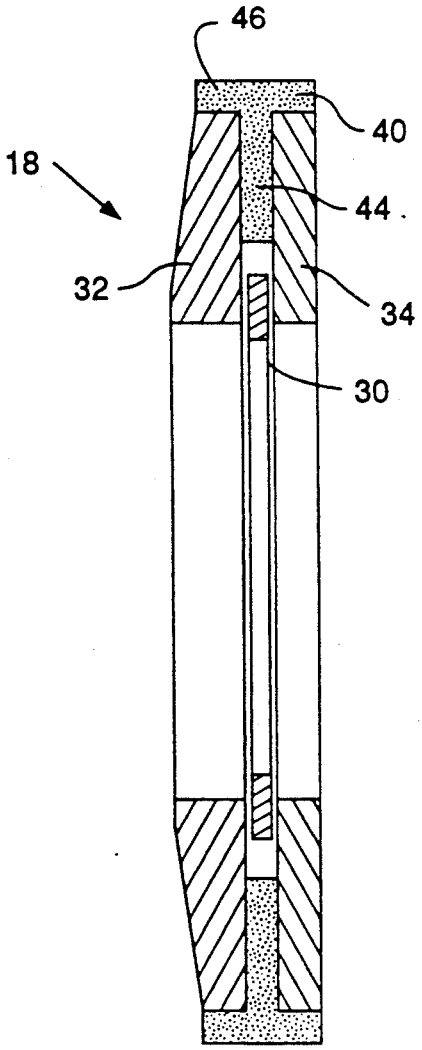
FIG. 8 is a modified embodiment of the invention of FIG. 5.

Referring now to FIG. 8, another embodiment of the pin retainer assembly 18 is illustrated. In this modification, elements the same or similar to elements from previous embodiments have the same element numbers. One side of one retaining member 32 of the at least two retaining members 32,34 has a frusto-conical shape. The frusto-conical shaped side is positioned on the outboard side of the one retaining member 32 away from the split retaining ring 30. The remaining elements of FIG. 8 are the same as those described and illustrated with respect to FIGS. 5–7. It is recognized that another one 34 of the at least two retaining members 32,34 could likewise have a frusto-conical shape on one side thereof that is opposite the split retaining ring 30.

Figure 9:
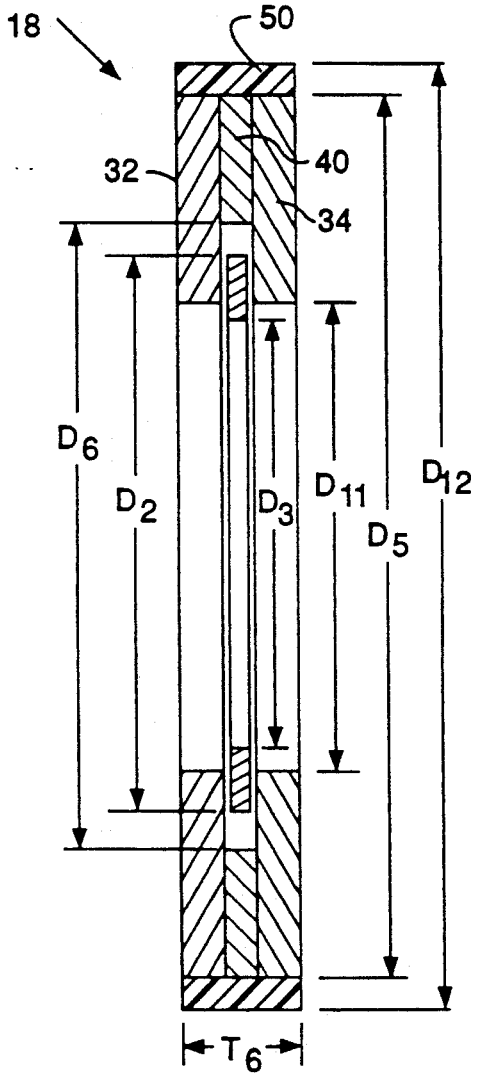
FIG. 9 is a cross-sectional view of another embodiment of the present invention.

Referring now to FIG. 9 another embodiment of the pin retaining assembly 18 is illustrated. In this embodiment, elements the same or similar to elements from previous embodiments have the same element numbers. The at least two retaining members 32,34 and the positioning member 40 are generally the same as those set forth with respect to FIGS. 1–4. However, it is recognized that the innermost diameter $D_6$ of the positioning member 40 could be larger than the outermost diameter $D_2$ of the split retaining ring 30 without departing from the essence of the invention. The subject embodiment includes a second positioning member 50. The second positioning member 50 has an innermost diameter $D_{11}$, an outermost diameter $D_{12}$, and a thickness $T_6$. The innermost diameter $D_{11}$ of the second positioning member 50 is generally the same as the outermost diameters $D_4$ of the at least two retaining members 32,34 and the outermost diameter $D_7$ of the first positioning member 40 of FIG. 3. The thickness $T_6$ of the second positioning member 40 is generally the same as the combined thickness of the at least two retaining members 32,34 and the thickness $T_3$ of the first positioning member 40. The second positioning member 50 may be bonded to the at least two retaining members 32,34 or may be secured thereto by an interference fit without departing from the essence of the invention.

Figure 10:
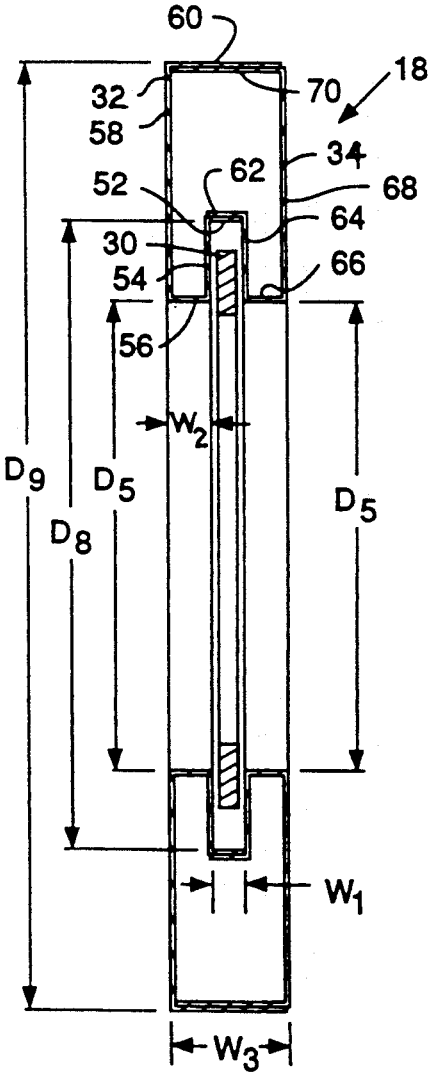
FIG. 10 is a cross-sectional view of yet another embodiment of the present invention.

Referring to FIG. 10 another embodiment of the pin retaining assembly 18 is illustrated. The split retaining ring 30 of the subject embodiment is the same as that set forth in the previous embodiments. The at least two retaining members 32,34 of this arrangement are formed from sheet metal. One retaining member 32 of the at least two retaining members 32,34 is formed to define a cylindrical portion 52, a first side wall 54, an innermost cylindrical portion 56, a second side wall 58 and an outermost cylindrical portion 60. The cylindrical portion 52 has an inner diameter $D_8$ that is generally the same size as the innermost diameter $D_8$ of the first portion 44 of the first positioning member 40 of FIG. 6 and a predetermined width $W_1$ generally the same as the thickness $T_3$ of the positioning member 40.

The first side wall 54 interconnects the cylindrical portion 52 with the innermost cylindrical portion 56. The innermost cylindrical portion 56 has an innermost diameter $D_5$ that is generally the same size as the innermost diameter $D_5$ of the retaining members 32,34 and has a width $W_2$ that is generally the same as the thickness $T_2$ of the at least two retaining members 32,34 noted above.

The second side wall 58 interconnects the innermost cylindrical portion 56 with the outermost cylindrical portion 60. The outermost cylindrical portion 60 has an outermost diameter $D_9$ that is generally the same size as the outermost diameter $D_9$ of the at least two retaining members 32,34 of FIG. 6. The outermost cylinder portion 60 has a width $W_3$ that is generally the same as the thickness $T_5$ of the second portion 46 of the first positioning member 46 of FIG. 6.

Another retaining member 34 of the at least two retaining members 32,34 is formed to define a cylindrical portion 62, a first side wall 64, an innermost cylindrical portion 66, a second side wall 68, and an outermost cylindrical portion 70. The cylindrical portion 62 of the another retaining member 34 is of size sufficient to be disposed around the cylindrical portion 52 of the one retaining member 32 and has an interference fit therewith.

The first side wall 64 of the another retaining member 34 connects the innermost cylindrical portion 66 with the cylindrical portion 62. The innermost cylindrical portion 66 of the another retaining member 34 has an innermost diameter $D_5$ the same size as the innermost diameter $D_5$ of the innermost cylindrical portion 56 of the one retaining member 32.

The second side wall 68 of the another retaining member 34 connects the innermost portion 66 to the outermost cylindrical portion 70 thereof. The outermost cylindrical portion 70 has a size sufficient to be disposed within the outermost cylindrical portion 60 of the one retaining member 32 and has an interference fit therewith. Once the one retaining member 32 and the another retaining member 34 are pressed together, the split retaining ring 30 is loosely sandwiched therebetween.

Referring now to FIG. 11 a modified embodiment of the split retaining ring 30 is illustrated. In this embodiment, elements the same or similar to elements from previous embodiments have the same element numbers. The split retaining ring 30 of this embodiment has a cross-section, taken parallel with the axes thereof, that is circular in cross-section. Likewise, the groove 16 in the pin 14 has a shape to match the circular shape of the split retaining ring 30. The depth of the groove 16 is generally equal to or greater than one-half the diameter of the circular cross-section of the split retaining ring 30. All other elements are the same as those set forth above with respect to the FIG. 3 embodiments.

Referring now to FIG. 12, another embodiment of the pin retainer assembly 18 is illustrated. The split retaining ring 30 of the subject embodiment is the same as that set forth in the previous embodiments. The at least two retaining members 32,34 hereof have the same outermost diameter $D_4$ and the same innermost diameter $D_5$ of the retaining members set 32,34 set forth with respect to FIGS. 1–9 above. As opposed to being generally flat members as illustrated above, the at least two retaining members 32,34 of the subject embodiment have a conical shape. Each of the at least two retaining members 32,34 has a concave side 72 and a convex side 74. The concave side 72 of each of the at least two retaining members 32,34 are placed adjacent one another with the split retaining ring 30 loosely sandwiched therebetween. The at least two retaining members 32,34 are secured together by the connecting means 36. In this embodiment, the connecting means 36 may be accomplished by bonding with any known method or by a mechanical connection, such as crimping.

It is recognized that the split retaining ring 30, having either the rectangular cross-section or the round cross-section, could be used in each of the above noted embodiments without departing from the essence of the invention. Naturally, the groove 16 in the pin 14 has to have a depth equal to or greater than one half the diameter of the split retaining ring 30. Furthermore, even though the at least two retaining members 32,34 have the shape of metal washers, it is recognized that they may be made into other shapes and from other materials so that when connected together the split retaining ring 30 is loosely sandwiched therebetween.

Industrial Applicability

With reference to FIGS. 1–4, the split retaining ring 30 is loosely sandwiched between the two retaining members 32,34 and held in general axial alignment therewith by the positioning member 40. Once the pin retainer assembly 18 is placed in the centering member 24 and the two elements placed in the counterbore 22, the tooth 10 is placed in position over the adapter nose 12. The pin 14 is inserted through the pair of aligned holes 28, the centering member 24, the pin retainer assembly 18, and the transverse bore 20 until the split retaining ring 30 fits into the groove 16 of the pin 14.

As is known, once the split retaining ring 30 is positioned in the groove 16, the pin cannot be removed without sufficient force being applied to the pin 14 to either shear the split retaining ring 30 or fracture the wall of one of the retaining members 32,34. It is recognized, however, that the groove 16 could be formed so that the split retaining ring 30 could "ramp-out" of the groove 16 instead of shearing the split retaining ring 30 without departing from the essence of the invention. Since the at least two retaining members 32,34 may be made from standard washers and the connecting means 36 may be made from various inexpensive materials, the final assembly is a very effective pin retainer assembly 18 and inexpensive to produce.

Since the positioning member 40 of the subject embodiment is compressible, the split retaining ring 30 can easily expand to slip over the outer diameter of the pin 14 during assembly. Once the pin 14 is properly assembled, the positioning member 40 is no longer functional. Consequently, it does not make any difference whether the positioning member 40 returns to its original shape or it remains in a compressed condition.

With reference to FIGS. 5-7, the pin retainer assembly 18 is positioned in the counterbore 22 without the use of a centering member 24. When a centering member 24 is not used, it is recognized that the diameter of the counterbore 22 of the nose 12 is of a size sufficient for the pin retainer assembly 18 of the subject embodiment to slip into the counterbore 22. Consequently, the pin retainer assembly 18 self centers itself in the counterbore 22. However, it is recognized that a centering member 24 could be used to hold and locate the pin retainer assembly 18 without departing from the essence of the invention. Likewise, in the other embodiments noted above if a centering member 24 is not used, the outer diameter $D_9$thereof is of a size sufficient to slip into the counterbore 22 and center the pin retainer assembly 18 therewith.

As previously noted, the at least two retaining members 32,34 could be made so that the cross-section of one or both of them could be L-shaped so that once the retaining members 32,34 are connected together the split retaining ring 30 is loosely sandwiched therebetween.

In the embodiments having the rigid positioning member 40, the innermost diameter $D_6$ thereof must be larger than the outermost diameter $D_2$ of the split retaining ring 30. The larger diameter is needed to allow the split retaining ring 30 sufficient space to expand when being slipped over the pin 14 during assembly. It is beneficial to control the innermost diameter $D_6$, so that it is not to large. It is preferred to maintain the split retaining ring 30 as near to the center axis of the pin retainer assembly 18 as possible. This is preferred because the pin 14 has to be passed through the split retaining ring 30 during assembly. If the split retaining ring 30 were to far from the center axis, the end of the pin 14 would hit the split retaining ring and not allow the pin 14 to pass therethrough.

In use, the operation of the pin retainer assembly 18 disclosed in all of the embodiments function in the same manner to retain the pin 14 in its assembled position. Furthermore, the use of one of the retaining members 32,34 having a frusto-conical side can be utilized in any of the embodiments. The use of the frusto-conical side surface aids in the transferring of disassembly forces directly to the split retaining ring 30 when the frusto-conical side of the retaining member 32 is located adjacent an angled surface which is many times present on teeth 10 and/or adapter noses 12.

In view of the foregoing, it is readily apparent that the structure of the present pin retainer assembly 18 provides an arrangement that functions to securely hold the pin 14 in its assembled position. Furthermore, the subject pin retainer assembly 18 can be made from standard, readily available and inexpensive components.

Other aspects, objects, and advantages of this invention can be obtained from a study of the drawings, the disclosure, and the appended claims.

We claim:

1. A pin retainer assembly adapted when in use to fit in a space between a tooth and an adapter nose and operative to retain a pin in a position which secures the tooth to the adapter nose, the pin defines a groove therein having a predetermined diameter, the pin retainer assembly comprising:

a split retaining ring having a predetermined thickness, a predetermined uniform outermost diameter extending substantially about the circumference, and a predetermined uniform innermost diameter extending substantially about the circumference which is generally the same size as the predetermined diameter of the groove defined in the pin and when assembled the split retaining ring fits into the groove of the pin;

at least two retaining members each being immediately adjacent the split retaining ring and having a predetermined innermost diameter less than the predetermined outermost diameter of the split retaining ring and a predetermined outermost diameter greater than the predetermined outermost diameter of the split retaining ring and being operative to loosely encapsulate the split retaining ring therebetween; and means for connecting the at least two retaining members together.

2. The pin retainer assembly of claim 1 wherein the connecting means includes a positioning member having a predetermined innermost diameter that is generally equal to or larger than the outermost diameter of the split retaining ring and has a predetermined thickness that is greater than the predetermined thickness of the split retaining ring.

3. The pin retainer assembly of claim 3 wherein one of the at least two retaining members has a cylindrical portion of a predetermined width with an inner diameter that is larger than the uniform outermost diameter of the split retaining ring, an innermost cylindrical portion having an innermost diameter the same as the innermost diameter of the at least two retaining members, and an outermost cylindrical portion of a predetermined width with an outermost diameter the same as the outermost diameter of the at least two retaining members.

4. The pin retainer assembly of claim 3 wherein the predetermined width of the cylindrical portion is greater than the predetermined thickness of the split retaining ring.

5. The pin retainer assembly of claim 4 wherein another one of the at least two retaining members has a cylindrical portion of a size sufficient to be disposed around the cylindrical portion of the one retaining member, an innermost cylindrical portion with an innermost diameter the same size as the innermost diameter of the one retaining member and being connected to the cylindrical portion thereof, and an outermost cylindrical portion of a size sufficient to be disposed within the outermost cylindrical portion of the one retaining member.

6. The pin retainer assembly of claim 5 wherein the one retaining member and the another retaining member of the at least two retaining members are formed from sheet metal and are operative to loosely encapsulate the split retaining ring therebetween.

7. The pin retainer assembly of claim 2 wherein one side of the one retaining member of the at least two retaining members has a frusto-conical shape.

8. The pin retainer assembly of claim 7 wherein the frusto-conical shape on the one side of the one retaining member is on the outboard side thereof when the one retaining member is bonded to the positioning member of the connecting means.

9. The pin retainer assembly of claim 2 wherein the positioning member has an outermost diameter generally equal to the outermost diameter of the at least two retaining members and the connecting means includes a second positioning member having an innermost diameter that is generally equal to the outermost diameter of the first positioning member and the at least two retaining members, and has a thickness generally equal to the combined thickness of the first positioning member and the at least two retaining members and operative to encapsulate the first positioning member and the at least two retaining members.

10. The pin retainer assembly of claim 9 wherein the at least two retaining members are metal washers and the first positioning member, the second positioning member and the at least two metal washers are bonded one to the other with the split retaining ring sandwiched between the at least two metal washers.

11. The pin retainer assembly of claim 1 wherein the at least two retaining members are conical spring washers each having a concave surface on one side thereof.

12. The pin retainer assembly of claim 11 wherein the connecting means includes bonding the at least two conical spring members together with their respective concave surfaces being adjacent one another.

13. The pin retainer assembly of claim 2 wherein the positioning member of the connecting means is a compressible positioning member and has an outermost diameter generally equal to the outermost diameter of the at least two retaining members.

14. A pin retainer assembly adapted when in use to fit in a space between a tooth and an adapter nose and operative to retain a pin in a position which secures the tooth to the adapter nose, the pin defines a groove therein having a predetermined diameter, the pin retainer assembly comprising:

a split retaining ring having a predetermined thickness, a predetermined outermost diameter and a predetermined innermost diameter which is generally the same size as the predetermined diameter of the groove defined in the pin and when assembled the split retaining ring fits into the groove of the pin;

at least two retaining members each having a predetermined innermost diameter less than the predetermined outermost diameter of the split retaining ring and a predetermined outermost diameter greater than the predetermined outermost diameter of the split retaining ring; and a positioning member having a predetermined innermost diameter that is generally equal to or larger than the outermost diameter of the split retaining ring, a predetermined thickness that is greater than the predetermined thickness of the split retaining ring, and an additional portion that extends radially outward beyond the outermost diameter of the at least two retaining members and axially to encapsulate each of the at least two retaining members, the positioning member in cooperation with the two retaining members being operative to position and to loosely encapsulate the split retaining ring therein.

15. The pin retainer assembly of claim 14 wherein the innermost diameter of the positioning member is greater than the outermost diameter of the split retaining ring.

16. The pin retainer assembly of claim 15 wherein the at least two retaining members are metal washers and the positioning member is formed from a plastic material.

17. The pin retainer assembly of claim 16 wherein the cross section of the split retaining ring taken parallel to its axis is generally rectangular.

18. The pin retainer assembly of claim 16 wherein the cross section of the split retaining ring taken parallel to its axis is generally circular.

19. The pin retainer assembly of claim 14 wherein the positioning member is a compressible positioning member.

20. A pin retainer assembly adapted when in use to fit in a space between a tooth and an adapter nose and operative to retain a pin in a position which secures the tooth to the adapter nose, the pin defines a groove therein having a predetermined diameter, the pin assembly comprising:

a split retaining ring having a predetermined thickness, a predetermined outermost diameter and a predetermined innermost diameter which is generally the same size as the predetermined diameter of the groove defined in the pin and when assembled the split retaining ring fits into the groove of the pin;

at least two sheet metal retaining members, one of the at least two sheet metal retaining members having a cylindrical portion adapted to receive the split retaining ring, an innermost cylindrical portion connected to the cylindrical portion, and an outermost cylindrical portion connected to the innermost cylindrical portion, the cylindrical portion has a predetermined width that is greater than the predetermined thickness of the split ring and has an inner diameter, that is larger than the outermost diameter of the split retaining ring, the innermost cylindrical portion has an innermost diameter that is smaller than the outermost diameter of the split retaining ring, and the outermost cylindrical portion having a predetermined width and an outermost diameter, the other one of the at least two sheet metal retaining members having a cylindrical portion of a size sufficient to be disposed around the cylindrical portion of the one retaining member, an innermost cylindrical portion having an innermost diameter the same size as the innermost diameter of the one retaining member, and an outermost cylindrical portion of a size sufficient to be disposed within the outermost cylindrical portion of the one retaining member; and connecting means including the frictional engagement between the cylindrical portion of the one sheet metal retaining member and the cylindrical portion of the other sheet metal retaining member and the frictional engagement between the outermost cylindrical portion of the one sheet metal retaining member and the outermost cylindrical portion of the other sheet metal retaining member so that the split retaining ring is loosely encapsulated therein.

21. The pin retainer assembly of claim 20 wherein the cross section of the split retaining ring taken parallel to its axis is generally rectangular.

22. The pin retainer assembly of claim 20 wherein the cross section of the split retaining ring taken parallel to its axis is generally circular.

* * * * *

UNITED STATES PATENT AND TRADEMARK OFFICE

CERTIFICATE OF CORRECTION

PATENT NO. : 5,172,500

DATED : December 22, 1992

INVENTOR(S) : WILLIAM J. RENSKI ET AL.

It is certified that error appears in the above-identified patent and that said Letters Patent is hereby corrected as shown below:

Column 8,

Claim 3, line 1, please delete "3" and insert --2--.

Signed and Sealed this

Twenty-sixth Day of October, 1993

*Attest:*

*Attesting Officer*

Bruce Lehman

BRUCE LEHMAN

*Commissioner of Patents and Trademarks*